US007443100B2

(12) United States Patent
Fukuyo et al.

(10) Patent No.: US 7,443,100 B2
(45) Date of Patent: Oct. 28, 2008

(54) ARC TUBE DISCHARGE LAMP WITH COMPRESSION STRAIN LAYER

(75) Inventors: Takeshi Fukuyo, Shizuoka (JP); Michio Takagaki, Shizuoka (JP); Akira Homma, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 217 days.

(21) Appl. No.: 11/248,228

(22) Filed: Oct. 13, 2005

(65) Prior Publication Data

US 2006/0082312 A1 Apr. 20, 2006

(30) Foreign Application Priority Data

Oct. 14, 2004 (JP) ..... P. 2004-299817
Sep. 9, 2005 (JP) ..... P. 2005-261997

(51) Int. Cl.
*H01J 17/04* (2006.01)
*H01J 61/04* (2006.01)

(52) U.S. Cl. ..... 313/633; 313/631

(58) Field of Classification Search ..... 315/73
See application file for complete search history.

(56) References Cited

U.S. PATENT DOCUMENTS 1,569,095 A * 1/1926 Laise ..... 252/515
3,317,356 A * 5/1967 Clendinning ..... 148/220
3,802,851 A * 4/1974 Dunham ..... 428/547
5,905,340 A * 5/1999 Karlotski et al. ..... 313/633
6,452,334 B1 * 9/2002 Ohshima et al. ..... 313/623
6,626,725 B1 * 9/2003 Bell ..... 445/35
6,650,054 B2 * 11/2003 Higashi et al. ..... 313/623
6,940,228 B2 * 9/2005 Aoki et al. ..... 313/633
2003/0042856 A1 * 3/2003 Kaneko et al. ..... 313/639
2003/0057835 A1 * 3/2003 Okanuma et al. ..... 313/631
2003/0168980 A1 * 9/2003 Hataoka e al. ..... 313/623
2004/0245930 A1 * 12/2004 Tukamoto et al. ..... 313/631

FOREIGN PATENT DOCUMENTS

JP 2001-15067 A 1/2001

* cited by examiner

*Primary Examiner*—Sikha Roy
*Assistant Examiner*—Tracie Y Green
(74) *Attorney, Agent, or Firm*—Sughrue Mion, PLLC

(57) ABSTRACT

In a mercury-free arc tube, electrodes are configured by electrode rods heat-treated at 1,200 to 2,200° C. in a vacuum atmosphere, and which have a thickness of 0.3 mm or more. The size (radius R) of a residual compression strain layer formed around the electrode rod is set to be ¼ or less of the width D of the pinch seal portion. A glass layer outside the residual compression strain layer is thickened, thereby enhancing the strength of the pinch seal portion.

8 Claims, 6 Drawing Sheets

40
42
44
22
26a
24a
W
W1
W2
A
50
52
54
26b
24b
8
7
8b
A'
60
P
Xe
W3
26c
LN2

ARC TUBE DISCHARGE LAMP WITH COMPRESSION STRAIN LAYER

The present application claims foreign priority based on Japanese Patent Application Nos. P.2004-299817, filed on Oct. 14, 2004, and P.2005-261997, filed on Sep. 9, 2005, the contents of which are incorporated herein by reference.

BACKGROUND OF THE INVENTION

1. Field of the Invention

The present invention relates to an arc tube for a discharge lamp device, in which the arc tube comprises a pair of tungsten electrode rods that are sealingly attached to pinch seal portions disposed in both ends of a glass tube, respectively, and that are opposed to each other in a closed glass bulb disposed in a middle of the glass tube with projecting tip end portions of the electrode rods thereinto, a starting rare gas, a light emitting substance, and the like being enclosed in the glass tube. More particularly, the present invention relates to an arc tube in which mercury that is an environmental toxic substance is not enclosed in the closed glass bulb (hereinafter, such an arc tube is referred to as a mercury-free arc tube).

2. Related Art

FIG. 9 shows a conventional discharge lamp device. The discharge lamp device has a structure in which a front end portion of an arc tube 5 is supported by one lead support 2 that is projected in front of an insulating base 1, a rear end portion of the arc tube 5 is supported by a recess 1*a* of the base 1, and a rear end side of the arc tube 5 is grasped by a metal supporting member S fixed to the front face of the insulating base 1.

A lead wire 8 on the front end side which is drawn out from the arc tube 5 is fixed to the lead support 2 by welding. A lead wire 8 on the rear end side penetrates a bottom face wall 1*b* formed in the recess 1*a* of the base 1, and is fixed to a terminal 3 disposed in the bottom face wall 1*b* by welding. The reference letter G denotes a cylindrical UV-blocking globe which cuts off UV components of the wavelength range that is harmful to the human body, from the light emitted from the arc tube 5, and which is integrated with the arc tube 5 by welding.

The arc tube 5 is structured so that a closed chamber portion (closed glass bulb) 5*a* is formed in which electrode rods 6, 6 are opposingly disposed between a pair of front and rear pinch seal portions 5*b* (a primary pinch seal portion 5*b*1, a secondary pinch seal portion 5*b*2), and a rare gas, mercury, a light emitting substance, and the like are enclosed. Molybdenum foils 7 through which the electrode rods 6 projected into the closed chamber portion 5*a* are connected to the lead wires 8 drawn out from the pinch seal portions 5*b* are sealingly attached into the pinch seal portions 5*b*, respectively, thereby ensuring the gas-tightness of the pinch seal portions 5*b*.

Most preferably, the electrode rods 6 are made of tungsten having superior durability. However, tungsten is largely different in coefficient of linear expansion from quartz glass which constitutes the arc tube, poor in compatibility with quartz glass, and has inferior gas-tightness. Therefore, the molybdenum foils 7 which are relatively excellent in compatibility with glass are connected to the tungsten electrode rods 6, and sealingly attached by the pinch seal portions 5*b*, whereby the gas-tightness of the pinch seal portions 5*b* is ensured. The electrode rods 6, the molybdenum foils 7, and the lead wires 8 are previously integrated with one another as electrode assemblies A1, A1'.

FIG. 10 shows an arc tube disclosed in JP-A-2001-015067. In the periphery of the electrode rod 6 in each of the pinch seal portions 5*b* (5*b*1, 5*b*2), a residual compression strain layer 9 surrounding the electrode rod 6, and an interface crack 9*a* elongating along the interface between the residual compression strain layer 9 and an outside glass layer are formed so as to suppress generation of a vertical crack (a crack which elongates from the periphery of the electrode rod toward the surface of the pinch seal portion) which may cause lighting failure or the like, in the pinch seal portion 5*b*. When the arc tube lights ON, specifically, thermal stress is generated between the electrode rod 6 and the glass layer in which the temperature difference between light-ON/OFF periods of the arc tube is large, and which are largely different in coefficient of linear expansion from each other. Particularly, recent arc tubes are configured so as to enable instant lighting, and have a large rate of temperature rise. In such an arc tube, therefore, thermal stress is rapidly generated. When this state is repeated, a vertical crack is generated at a sealingly attached position of the pinch seal portion (glass layer) 5*b* to which the electrode rod 6 is sealingly attached, and the substances enclosed in the closed chamber portion 5*a* leaks, thereby causing a possibility that lighting failure or reduction of the life period may occur. However, the residual compression strain layer 9 surrounding the electrode rod 6, and the interface crack 9*a* efficiently relax (absorb) thermal stress which is generated in the glass layer in accordance with temperature rise. In this structure, therefore, a vertical crack which may cause the enclosed substances to leak is not generated in the pinch seal portion (glass layer) 5*b*.

In the closed glass bulb 5*a* of the conventional arc tube of these type, mercury which performs a buffer function (a function of maintaining an adequate tube voltage) is enclosed. However, mercury is an environmental toxic substance. In order to satisfy social needs that environmental contamination of the earth is reduced as far as possible, there is a mercury-free arc tube, as a related art of the present invention, in which mercury is not enclosed in a closed glass bulb.

However, in the related art mercury-free arc tube, a novel problem that a vertical crack, which is hardly generated in a mercury arc tube, is generated in a pinch seal portion has arisen.

The problem is caused by the following phenomenon. In the pinch seal portion of the mercury-free arc tube, the residual compression strain layer (interface crack) around the electrode rod is formed larger (the radius of the residual compression strain layer or the interface crack is larger) than that in the mercury arc tube. Therefore, the glass layer outside the residual compression strain layer (interface crack) in the pinch seal portion is correspondingly made thinner. When thermal stress which exceeds the stress absorption limit of the residual compression strain layer (interface crack) (hereinafter, referred to as excessive thermal stress) acts on the pinch seal portion, a vertical crack is generated.

That is, as a countermeasure against reduction of the tube voltage due to mercury free, a mercury-free arc tube is configured so as to thicken an electrode rod in order to increase the tube current, thereby maintain the tube power. However, the configuration of a pincher for shaping the pinch seal portion (the sizes of a section face of the pinch seal portion, and the like) is identical with that in the case of a mercury arc tube. By contrast, in the pinch seal portion, the amount of thermal contraction of the electrode rod after pinch seal is larger correspondingly with the thickness of the electrode rod, and also the residual compression strain layer (interface crack) formed around the electrode rod is larger (the radius of the residual compression strain layer or the interface crack is larger) than that in the case of a mercury arc tube. Consequently, the glass layer outside the residual compression strain layer (interface crack) in the pinch seal portion is correspondingly thinner than that in a mercury arc tube. When excessive thermal stress acts on the pinch seal portion, therefore, a vertical crack is generated.

SUMMARY OF THE INVENTION

In accordance with one or more embodiments of the present invention, there is provided a mercury-free arc tube in which an electrode rod has a large diameter, the size (radius) of a residual compression strain layer (interface crack) formed in a pinch seal portion is reduced, and a glass layer outside the residual compression strain layer (interface crack) in the pinch seal portion is correspondingly thickened, so that, even when excessive thermal stress acts on the pinch seal portion, a vertical crack is not generated.

Moreover, in accordance with one or more embodiments of the present invention, the electrode rod may comprise a thoriated tungsten electrode rod, and the electrode rod maybe heat-treated in a vacuum atmosphere and at a predetermined temperature proportional to the diameter of the electrode rod in a range from 1,600 to 2,200° C. Moreover, in accordance with one or more embodiments of the present invention, tungsten crystal grains constituting a surface structure of each of the electrode rods may have a maximum length of 5 μm or longer. From relationships between a vacuum heat treatment temperature of an electrode rod and the surface structure of the electrode rod (FIG. 4), between the thickness of an electrode rod which was not vacuum heat-treated, and the size of a residual compression strain layer (interface crack) (FIG. 5), between the size (radius) of a residual compression strain layer (interface crack) formed around an electrode rod which was not vacuum heat-treated, and the rate of generation of a vertical crack (FIG. 6), and between the thickness and vacuum heat treatment temperature of an electrode rod which was vacuum heat-treated, and the size (radius) of a residual compression strain layer (interface crack) formed in a pinch seal portion (FIG. 7A), the use of thoriated tungsten electrode rods heat-treated in a vacuum atmosphere and in a range from 1,600 to 2,200° C. as tungsten electrode rods which are to be opposed to each other in a closed glass bulb of a mercury-free arc tube is effective in suppressing generation of a vertical crack in a pinch seal portion (FIGS. 6 and 7A). Moreover, when the size (radius) of a residual compression strain layer (interface crack) formed in the pinch seal portion is reduced, specifically, when the size (radius R) of the residual compression strain layer is D/4 or less about the electrode rods with respect to the width D of the pinch seal portion, the thickness of a glass layer outside the residual compression strain layer (interface crack) is ensured, the heat resistance of the pinch seal portion is enhanced (generation of a vertical crack is suppressed), and the life period of the arc tube is prolonged.

Moreover, in accordance with one or more embodiments of the present invention, the electrode rod may comprise a kalium-doped tungsten electrode rod or a high-purity tungsten electrode rod. When the kalium-doped tungsten electrode rod or the high-purity tungsten electrode rod is used as the electrode rod opposed to each other in the closed glass bulb, even if any heat treatments are applied to the electrode rod in advance, the size (radius R) of the residual compression strain layer (interface crack) on the pinch seal portion becomes D/4 or less about the electrode rods with respect to the width D of the pinch seal portion. As a result, the thickness of a glass layer outside the residual compression strain layer (interface crack) is ensured, so that the heat resistance of the pinch seal portion is enhanced (generation of a vertical crack is suppressed), and the life period of the arc tube is prolonged.

Moreover, in accordance with one or more embodiments of the present invention, the kalium-doped tungsten electrode rod may be heat-treated in a vacuum atmosphere and at a predetermined temperature proportional to the diameter of the electrode rod in a range from 1,400 to 2,000° C., or the high-purity tungsten electrode rod may be heat-treated in a vacuum atmosphere and at a predetermined temperature proportional to the diameter of the electrode rod in a range from 1,200 to 1,800° C. When the kalium-doped tungsten electrode rod is heat-treated in the vacuum atmosphere and at the temperature from 1,400 to 2,000° C. in advance, or the high-purity tungsten electrode rod is heat-treated in the vacuum atmosphere and at the temperature from 1,200 to 1,800° C. in advance, the size (radius R) of the residual compression strain layer (interface crack) on the pinch seal portion is further reduced. As a result, the heat resistance of the pinch seal portion is further enhanced (generation of a vertical crack is suppressed), and the life period of the arc tube is further prolonged.

One or more embodiments of the present invention provide a mercury-free arc tube for a discharge lamp device in which there is no possibility that a vertical crack is generated in a pinch seal portion by a change of thermal stress at light-ON/OFF (the heat resistance of the pinch seal portion is enhanced).

In accordance with one or more embodiments of the present invention, a mercury-free arc tube for a discharge lamp device is provided with a pair of tungsten electrode rods that are sealingly attached to pinch seal portions disposed in both ends of a glass tube, respectively, and that are opposed to each other in a closed glass bulb disposed in a middle of the glass tube with projecting tip end portions of the electrode rods thereinto, a starting rare gas, a light emitting substance, and the like being enclosed in the closed glass bulb; a residual compression strain layer formed in a contact face between a glass layer in each of the pinch seal portions and corresponding one of the electrode rods; and a residual compression strain layer surrounding the electrode rod. In the mercury-free arc tube, the electrode rods are configured to have a diameter of 0.3 mm or more, and the residual compression strain layers are formed to have a radius R ($\leqq$D/4) about corresponding one of the electrode rods with respect to a width D of the pinch seal portions.

In the interfaces between the glass layers and the electrode rods immediately after pinch seal, thermal stress is not generated. When the temperature is returned to the ordinary one, however, a mode is established in which, on the interfaces between the electrode rods (tungsten) and the glass layers (quartz glass), thermal stress (tensile stress on the electrode rods, and compression stress on the glass layers) corresponding to the difference between the coefficients of linear expansion of the members acts, and strain of a certain degree (residual tensile strain in the electrode rods, and residual compression strain in the glass layers) remains to be generated. The temperature of the arc tube at light-ON is not raised to exceed that in pinch seal of the glass tube. In the case where the residual compression strain layer in the pinch seal portion is formed over a wide range, therefore, thermal stress generated by light-ON in the pinch seal portion of the arc tube acts so as to previously reduce compression strain residual in the glass layer of the pinch seal portion at light-OFF, in both the axial and circumferential directions of the electrode rods.

Namely, the residual compression strain layer of a predetermined thickness (and an interface crack elongating along the interface between the compression strain layer and a glass layer outside the compression strain layer) is previously formed around the electrode rod in each of the pinch seal portions. The residual compression strain layer (and the interface crack) in the wide range efficiently relaxes (absorbs) thermal stress which is generated in the pinch seal portion in accordance with temperature rise. In other words, thermal stress which is repeatedly generated is dispersed by the residual compression strain layer (interface crack) existing over the predetermined wide range, and transmitted toward the glass layer outside the residual compression strain layer (interface crack). Therefore, generation of a vertical crack which may lead to leakage of the enclosed substances is suppressed in the pinch seal portion.

In a mercury free arc tube, as a countermeasure against reduction of the tube voltage due to mercury free, preferably, an electrode rod is thickened in order to increase the tube current, thereby maintain the tube power. An electrode rod (having a thickness of 0.3 mm or more) which is thicker than an electrode rod (having a thickness of 0.2 to 0.25 mm) in a mercury arc tube is used. On the other hand, the configuration of a pincher for shaping the pinch seal portion (the size of a section face of the pinch seal portion, and the like) is identical with that in the case of a mercury arc tube. In the pinch seal portion, as shown in FIG. 5, the amount of thermal contraction of the electrode rod after pinch seal is large correspondingly with the thickness of the electrode rod, and also the residual compression strain layer (interface crack) around the electrode rod is formed larger (the radii of the residual compression strain layer and the interface crack are larger) than that in a mercury arc tube. Consequently, the glass layer outside the residual compression strain layer (interface crack) in the pinch seal portion is correspondingly thinner than that in the case of a mercury arc tube. When excessive thermal stress acts on the pinch seal portion, therefore, a vertical crack is easily generated.

When electrode rods (thoriated tungsten electrode rod) having a thickness of 0.25 to 0.4 mm are vacuum heat-treated in a range from 1,600 to 2,200° C., however, the size (radius) of a residual compression strain layer (interface crack) in a pinch seal portion (having a width of 2.2 mm) is reduced to 0.5 mm or less as shown in FIG. 7A. When the size (radius) of a residual compression strain layer (interface crack) in a pinch seal portion (having a width of 2.2 mm) is 0.5 mm or less, the rate of generation of a vertical crack is 0% as shown in FIG. 6. In one or more embodiments of the present invention, therefore, the residual compression strain layer is configured to have a radius R (≦D/4) about the electrode rod with respect to the width D of the pinch seal portion so that the size (radius) of the residual compression strain layer (interface crack) formed in the pinch seal has a radius of 0.5 mm or less with respect to the pinch seal portion of a width of, for example, 2.2 mm, and the glass layer having a sufficient thickness (a thickness of 0.6 mm or larger) is formed outside the residual compression strain layer (interface crack) in the pinch seal portion (having a width of 2.2 mm).

Moreover, as shown in FIGS. 7B and 7C, when the kalium-doped tungsten electrode rod or the high-purity tungsten electrode both having a thickness of 0.25 to 0.4 mm is used as the electrode rod, even if a heat treatment applied to, for example, the thoriated tungsten electrode rod is not applied thereto, the size (radius) of a residual compression strain layer (interface crack) in a pinch seal portion (having a width of 2.2 mm) is reduced to 0.5 mm or less. Therefore, in accordance with one or more embodiments of the present invention, only by using the kalium-doped tungsten electrode rod or the high-purity tungsten electrode instead of the thoriated tungsten electrode rod, the residual compression strain layer is configured to have a radius R (≦D/4) about the electrode rod with respect to the width D of the pinch seal portion. As a result, the glass layer having a sufficient thickness (a thickness of 0.6 mm or larger) is formed outside the residual compression strain layer (interface crack) in the pinch seal portion (having a width of 2.2 mm).

Even when excessive thermal stress acts on the pinch seal portion, therefore, a vertical crack is not generated in the glass layer. Specifically, the glass layer having a thickness corresponding to strength which can sufficiently withstand excessive thermal stress acting on the pinch seal portion is formed outside the residual compression strain layer (interface crack) in the pinch seal portion. Namely, the heat resistance of the pinch seal portion is improved.

In order to configure the residual compression strain layer so as to have a radius R (≦D/4) about the electrode rod with respect to the width D of the pinch seal portion, when the thoriated tungsten electrode rod is used as the electrode rod, it is preferable that the electrode rods are vacuum heat-treated at a temperature in a range from 1,600 to 2,200° C. In an electrode rod which is vacuum heat-treated at a high temperature of 1,600 to 2,200° C., not only water adsorbed to the surface of the electrode rod, and an oxide film, but also impurities (water and gases) in the electrode rod are removed away. Therefore, also characteristics such as the luminous flux and the luminous color are improved.

Further, in accordance with one or more embodiments of the present invention, it is preferable to use, as the electrode rod, the thoriated tungsten electrode rod heat-treated in a vacuum atmosphere and at a predetermined temperature proportional to the diameter of the electrode rod in a range from 1,600 to 2,200° C., the kalium-doped tungsten electrode rod heat-treated in a vacuum atmosphere and at a predetermined temperature proportional to the diameter of the electrode rod in a range from 1,400 to 2,000° C., or the high-purity tungsten electrode rod heat-treated in a vacuum atmosphere and at a predetermined temperature proportional to the diameter of the electrode rod in a range from 1,200 to 1,800° C.

(Function) As shown in FIGS. 7A, 7B and 7C, the size (radius) of the residual compression strain layer (interface crack) in the pinch seal portion is smaller as the vacuum heat treatment temperature of the electrode rod is higher, and also smaller as the thickness (diameter) of the electrode rod is thinner (smaller). Therefore, vacuum heat treatment at a high temperature is conducted on a thick electrode rod, and that at a low temperature is conducted on a thin electrode rod, whereby the residual compression strain layer (interface crack) in the pinch seal portion can be set to have a predetermined size irrespective of the thickness of the electrode rod. Namely, the temperature condition of the vacuum heat treatment corresponding to the thickness of the electrode rod is selected in the range from 1,600 to 2,200° C. for the thoriated tungsten electrode rod, from 1,400 to 2,000° C. for the kalium-doped tungsten electrode rod, and from 1,200 to 1,800° C. for the high-purity tungsten electrode rod, whereby a glass layer having a predetermined thickness which can sufficiently withstand excessive thermal stress acting on the pinch seal portion can be formed around the residual compression strain layer (interface crack).

Especially, by heat-treating the electrode rod in the range from 1,400 to 2,000° C. when the kalium-doped tungsten electrode rod is used, and from 1,200 to 1,800° C. when the high-purity tungsten electrode rod is used, as shown in FIGS. 7B and 7C, the size (radius) of a residual compression strain layer (interface crack) in a pinch seal portion (having a width of 2.2 mm) is further reduced, so that the glass layer having more sufficient thickness is formed outside the residual compression strain layer (interface crack) in the pinch seal portion (having a width of 2.2 mm), compared with the case that the thoriated tungsten electrode rod heat-treated in the vacuum atmosphere and at the predetermined temperature proportional to the diameter of the electrode rod in a range from 1,600 to 2,200° C.

In addition, even when the kalium-doped tungsten electrode rod or the high-purity tungsten electrode rod is used, similar to the case that the thoriated tungsten electrode rod is used, if the electrode rod is vacuum heat-treated, not only water adsorbed to the surface of the electrode rod, and an oxide film, but also impurities (water and gases) in the electrode rod are removed away. Therefore, also characteristics such as the luminous flux and the luminous color are improved.

Moreover, in accordance with one or more embodiments of the present invention, in the mercury-free arc tube for a discharge lamp, tungsten crystal grains constituting a surface structure of each of the electrode rods may have a maximum length of 5 μm or longer.

(Function) As shown in FIG. 4, the respective maximum lengths of crystal grains of the surface structure of the electrode rod which were treated at a vacuum heat treatment temperature of 1,600° C. for the thoriated tungsten electrode rod, of 1,400° C. for the kalium-doped tungsten electrode rod, and of 1,200° C. for the high-purity tungsten electrode rod are 5 μm, and, as the vacuum heat treatment temperatures are higher, the maximum lengths of crystal grains become larger. As shown in FIGS. 7A, 7B and 7C, the size (radius) of the residual compression strain layer (interface crack) formed in the pinch seal portion become smaller as the vacuum heat treatment temperature of the electrode rod is higher. In the case where the maximum length of tungsten crystal grains constituting the surface structure of an electrode rod is 5 μm or longer, therefore, the electrode rod was vacuum heat-treated at a temperature of 1,600° C. or higher in the thoriated tungsten electrode rod, 1,400° C. or higher in the kalium-doped tungsten electrode rod, and 1,200° C. or higher in the high-purity tungsten electrode rod. Consequently, the size (radius) of the residual compression strain layer (interface crack) formed in the pinch seal portion is 0.5 mm or less with respect to the pinch seal portion of a width of 2.2 mm as shown in FIGS. 7A, 7B and 7C, and the glass layer having a sufficient thickness (a thickness of 0.6 mm or larger) is formed outside the residual compression strain layer (interface crack) in the pinch seal portion (having a width of 2.2 mm). Even when excessive thermal stress acts on the pinch seal portion, therefore, a vertical crack is not generated in the glass layer.

As apparent from the above description, in accordance with one or more embodiments of the present invention, in the mercury-free arc tube for a discharge lamp device, the glass layer outside the residual compression strain layer (interface crack) is ensured to have a sufficient thickness increased by a degree corresponding to the reduction of the size (radius) of the residual compression strain layer (interface crack) formed around an electrode rod which is thicker than that in a mercury arc tube. Therefore, a mercury-free arc tube for a discharge lamp device in which, even when excessive thermal stress acts on a pinch portion, a vertical crack is not generated, and the heat resistance is improved is provided.

A pincher for shaping a pinch seal portion of a mercury arc tube can be used as that for shaping the pinch seal portion of the mercury-free arc tube, without changing the specification of the pincher. Consequently, the design of facilities for producing a mercury-free arc tube can be correspondingly facilitated.

In addition, in accordance with one or more embodiments of the present invention, each of the electrode rods is previously vacuum heat-treated at a high temperature of 1,600 to 2,200° C., 1,400 to 2,000° C., or 1,200 to 1,800° C., and hence the amounts of impurities (water and gases) in the closed glass bulb are very small, whereby the luminous flux and luminous color characteristics are improved.

Since the temperature condition of the vacuum heat treatment of each of the electrode rods is selected in accordance with the thickness of the electrode rod, it is possible to provide a mercury-free arc tube for a discharge lamp device in which, for example, the size of the residual compression strain layer (interface crack) in the pinch seal portion (the thickness of the outside glass layer) can be uniformalized irrespective of the thickness of the electrode rod, and, even when excessive thermal stress acts on the pinch seal portion, generation of a vertical crack can be further suppressed, and which has an excellent heat resistance of the pinch seal portion.

In addition, in accordance with one or more embodiments of the present invention, a glass layer having a sufficient thickness which can withstand excessive thermal stress acting on the pinch seal portion is formed around the residual compression strain layer (interface crack) in the pinch seal portion. Therefore, it is possible to provide a mercury-free arc tube for a discharge lamp device in which, even when excessive thermal stress acts on the pinch seal portion, generation of a vertical crack can be further suppressed, and which has an excellent heat resistance of the pinch seal portion.

Other aspects and advantages of the invention will be apparent from the following description and the appended claims.

DESCRIPTION OF THE PREFERRED EMBODIMENTS

Embodiments of the invention will be described with reference to the accompanying drawings.

Figure 1:
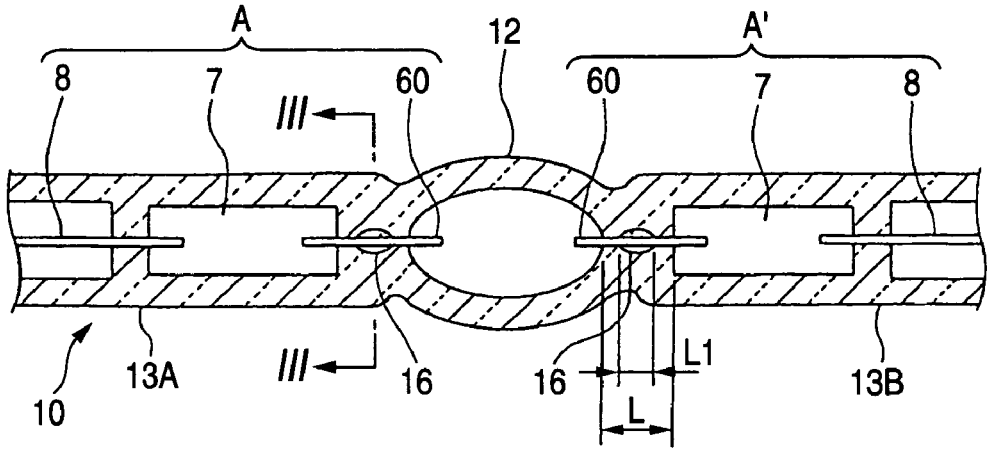
FIG. 1 is a longitudinal section view of a mercury-free arc tube for a discharge lamp device.
Figure 2:
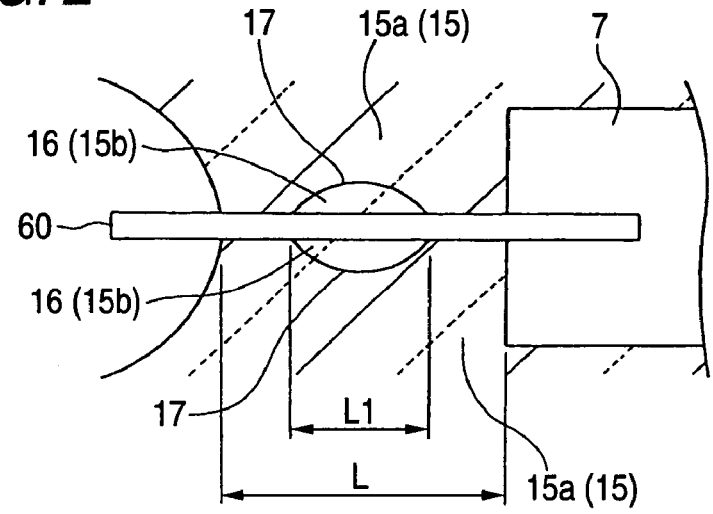
FIG. 2 is an enlarged section view showing main portions of a pinch seal portion of the arc tube.
Figure 3:
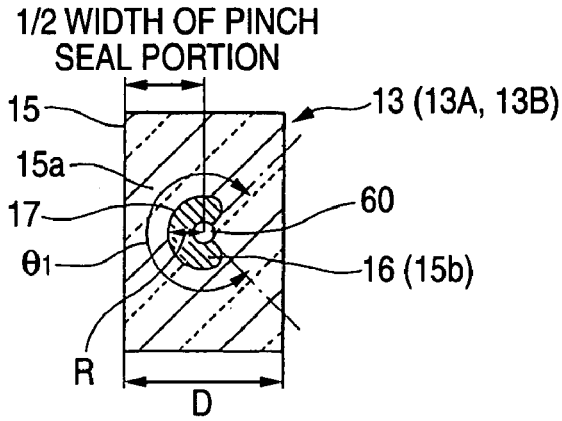
FIG. 3 is a cross section view taken along the line III-III of FIG. 1, including a residual compression strain layer in the pinch seal portion.
Figure 4:
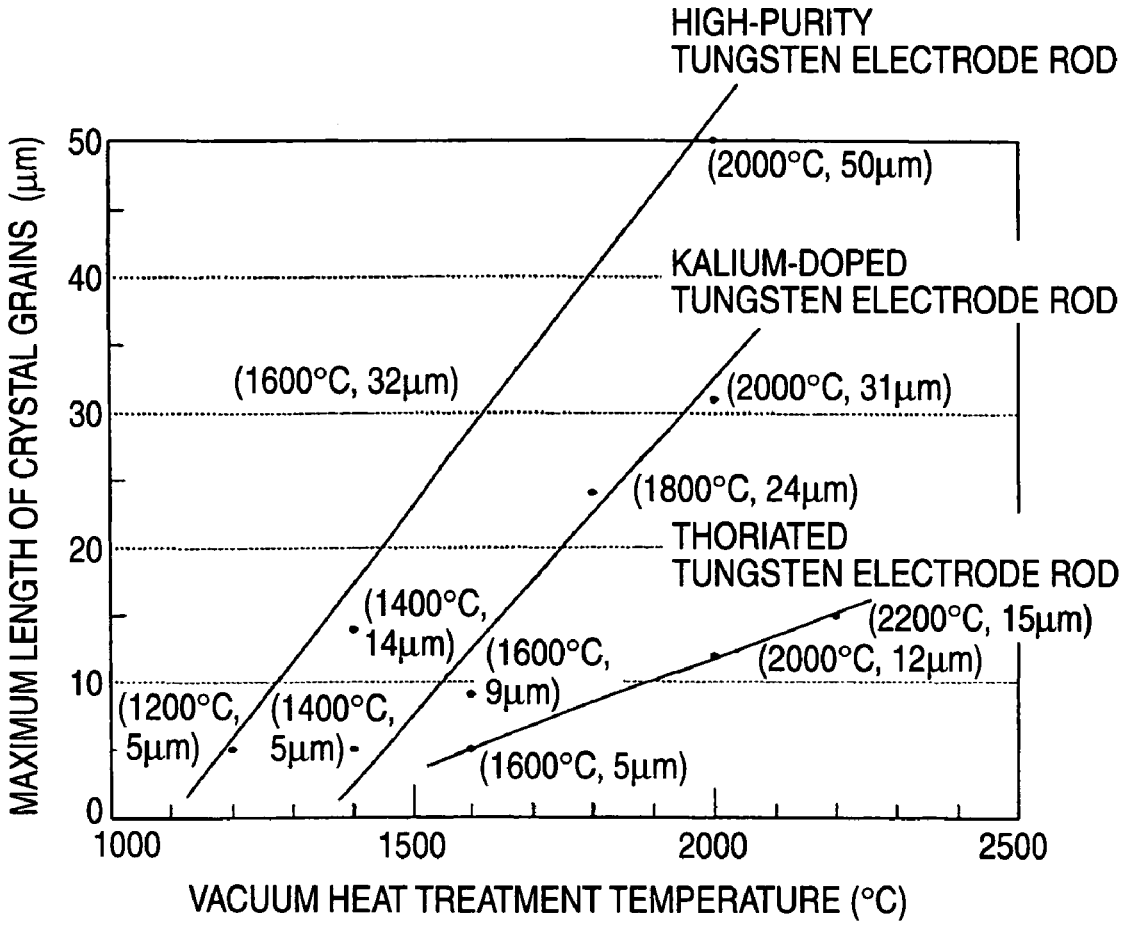
FIG. 4 is a view showing relationships between a vacuum heat treatment temperature of an electrode rod and the maximum length of crystal grains of the surface structure of the electrode rod.
Figure 5:
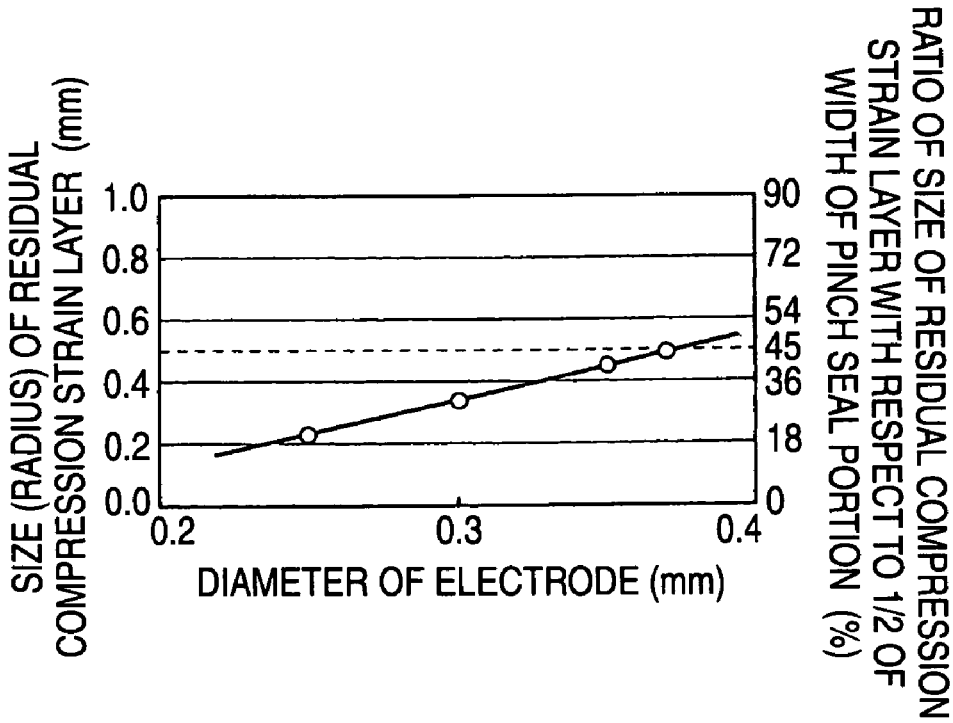
FIG. 5 is a view showing relationships between the thickness of an electrode rod which was not vacuum heat-treated, and the size (radius) of a residual compression strain layer (interface crack), and the rate of the size of the residual compression strain layer (interface crack) with respect to ½ of the width of the pinch seal portion.
Figure 6:
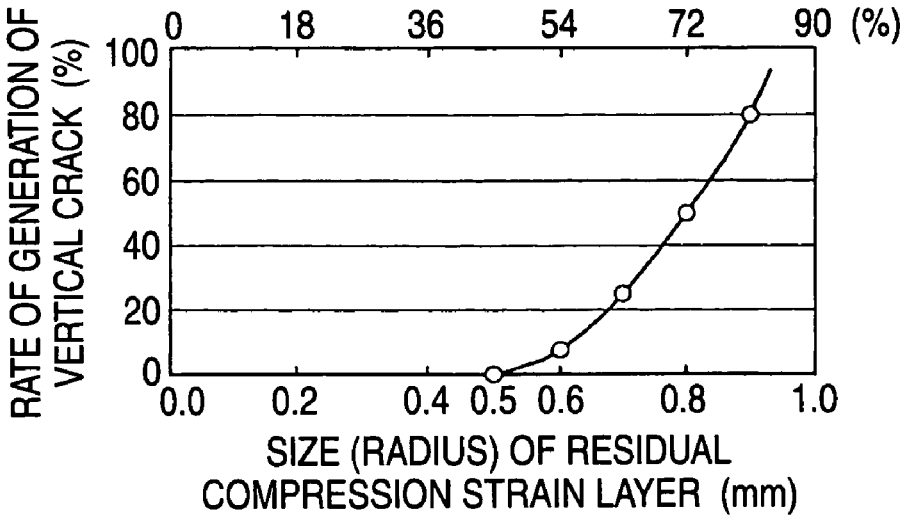
FIG. 6 is a view showing relationships between the size (radius) of a residual compression strain layer (interface crack) formed around an electrode rod which was not vacuum heat-treated, and the rate of generation of a vertical crack.
Figure 7A:
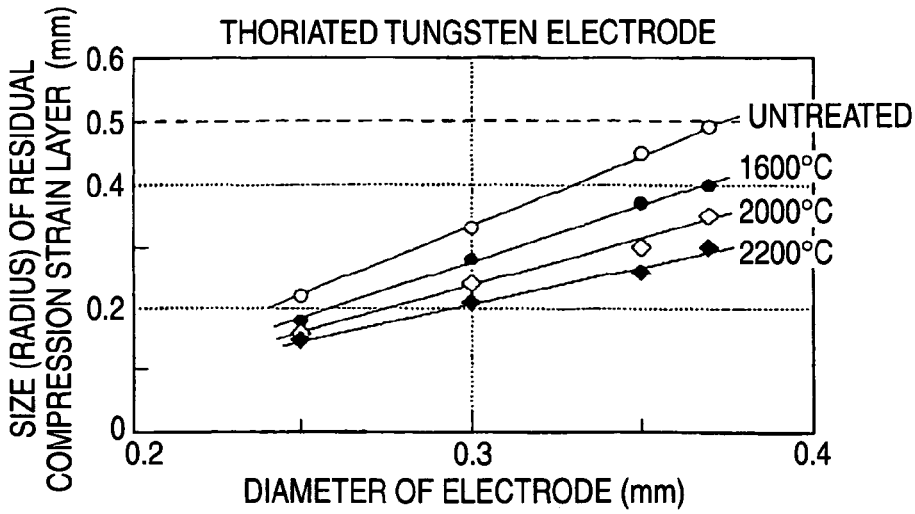
FIG. 7A shows relationship between the thickness and vacuum heat treatment temperature of an electrode rod which was vacuum heat-treated, and the size of residual compression strain layers (interface crack) formed in a pinch seal portion, when a thoriated tungsten electrode rod is used.
Figure 7B:
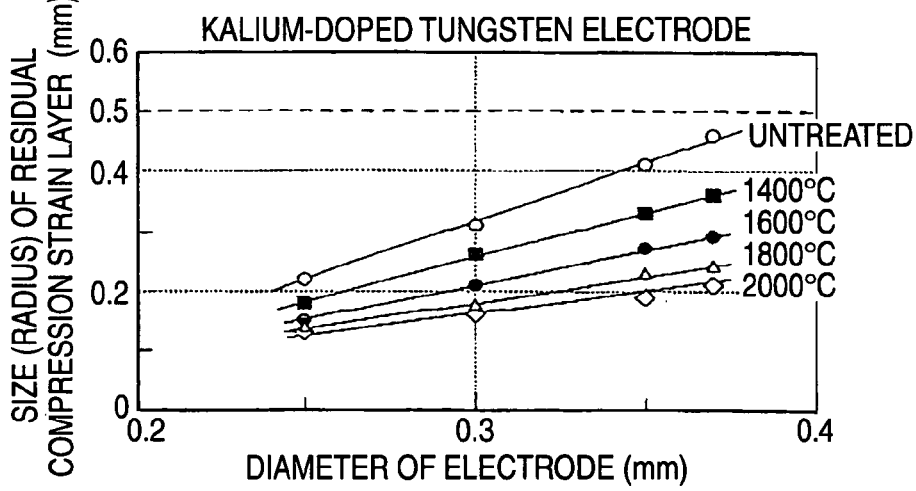
FIG. 7B shows relationship between the thickness and vacuum heat treatment temperature of an electrode rod which was vacuum heat-treated, and the size of residual compression strain layers (interface crack) formed in a pinch seal portion, when a kalium-doped tungsten electrode rod is used.
Figure 7C:
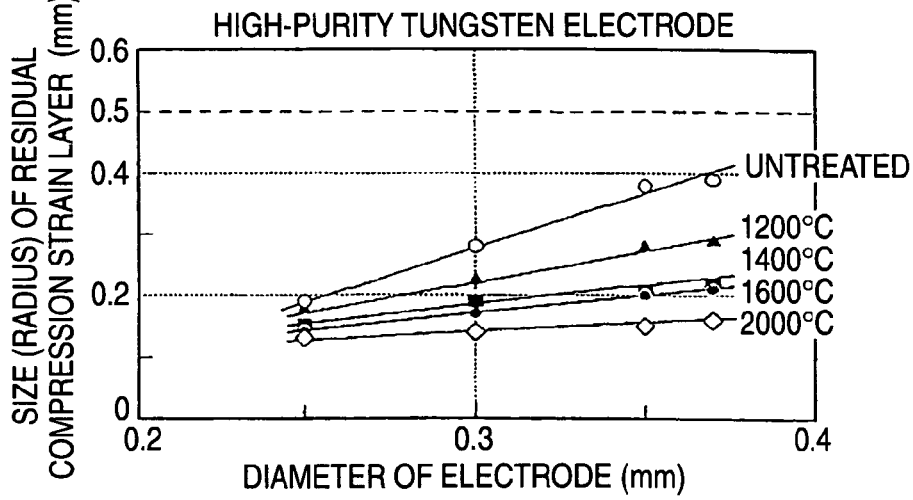
FIG. 7C shows relationship between the thickness and vacuum heat treatment temperature of an electrode rod which was vacuum heat-treated, and the size of residual compression strain layers (interface crack) formed in a pinch seal portion, when a high-purity tungsten electrode rod is used.
Figures 8A, 8B, 8C, 8D, 8E:
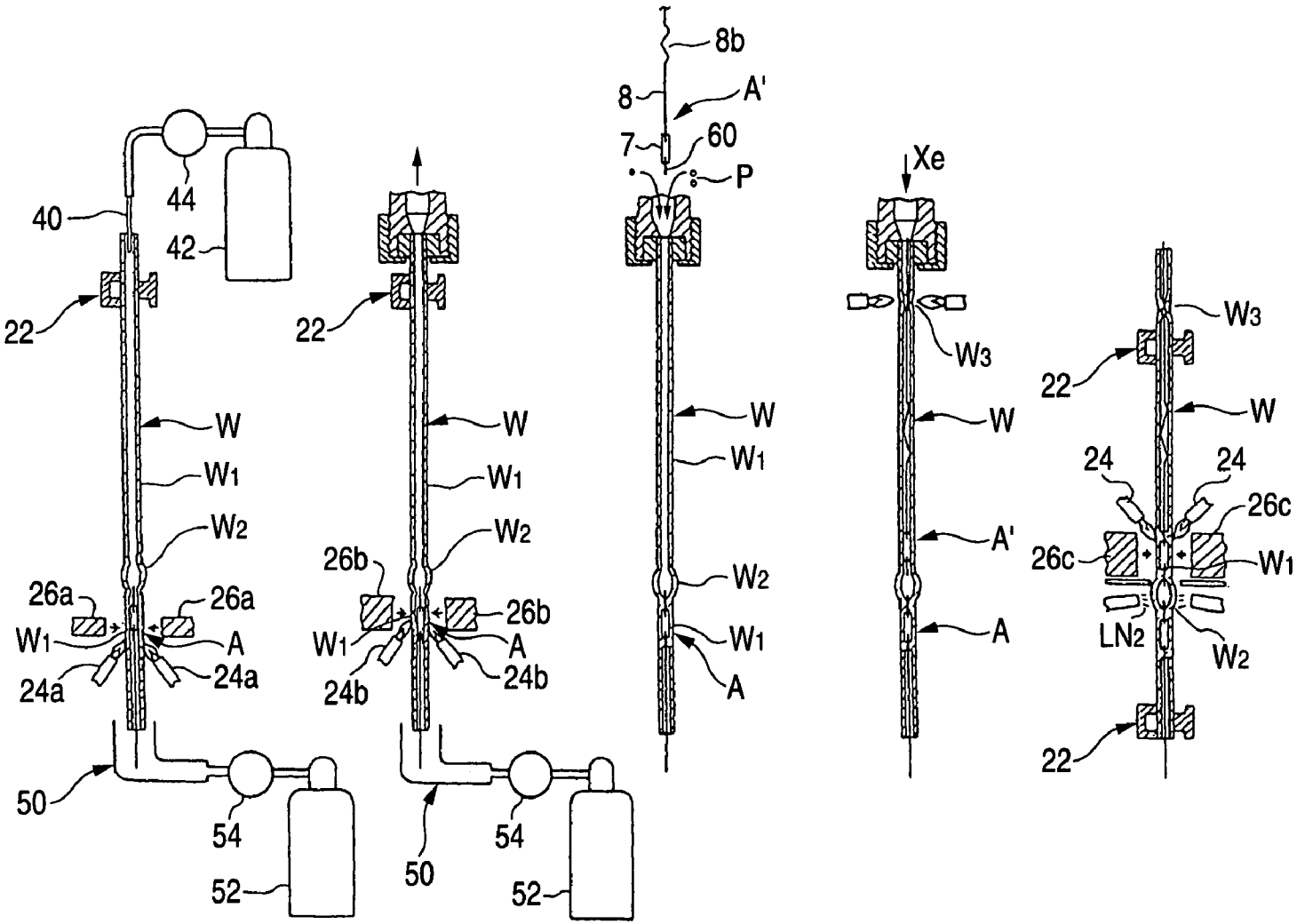
FIG. 8A is a view illustrating a primary pinch sealing step in producing steps of the arc tube.
FIG. 8B is a view illustrating a primary pinch sealing step in the producing steps of the arc tube.
FIG. 8C is a view illustrating a step of charging light emitting substances and the like in the producing steps of the arc tube.
FIG. 8D is a view illustrating a chip-off step in the producing steps of the arc tube.
FIG. 8E is a view illustrating a secondary pinch sealing step in the producing steps of the arc tube.

FIGS. 1 to 8E show an embodiment of the invention. FIG. 1 is a longitudinal section view of an arc tube for a discharge lamp device which is the embodiment of the invention. FIG. 2 is an enlarged section view showing main portions of a pinch seal portion of the arc tube. FIG. 3 is a cross section view (a section view taken along the line III-III of FIG. 1) including a residual compression strain layer in the pinch seal portion. FIG. 4 is a view showing relationships between a vacuum heat treatment temperature of an electrode rod and the maximum length of crystal grains of the surface structure of the electrode rod. FIG. 5 is a view showing relationships between the thickness of an electrode rod which was not vacuum heat-treated, and the size of a residual compression strain layer (interface crack), and the rate of the size of the residual compression strain layer (interface crack) with respect to the width of the pinch seal portion. FIG. 6 is a view showing relationships between the size of a residual compression strain layer (interface crack) formed around an electrode rod which was not vacuum heat-treated, and the rate of generation of a vertical crack. FIGS. 7A to 7C show relationship between the thickness and vacuum heat treatment temperature of an electrode rod which was vacuum heat-treated, and the size of residual compression strain layers (interface crack) formed in a pinch seal portion, in which FIG. 7A shows the case where the thoriated tungsten electrode rod is used, FIG. 7B shows the case where the kalium-doped tungsten electrode rod is used, and FIG. 7C shows the case where the high-purity tungsten electrode rod is used. FIGS. 8A to 8E are views illustrating steps of producing the arc tube in which FIGS. 8A and 8B are diagrams of a primary pinch sealing step, FIG. 8C is a diagram of a step of charging light emitting substances and the like, FIG. 8D is a diagram of a chip-off step, and FIG. 8E is a diagram of a secondary pinch sealing step.

Figure 9:
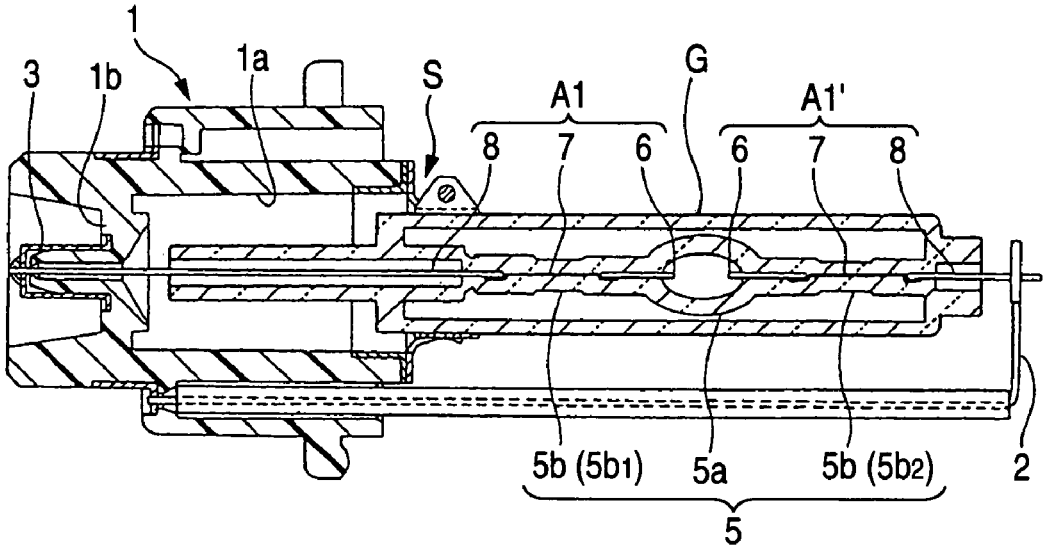
FIG. 9 is a longitudinal section view of a conventional discharge lamp device.

In the figures, the structure of the discharge lamp device to which the arc tube 10 is to be attached is identical with the conventional one shown in FIG. 9, and its description is omitted.

The arc tube 10 has a structure where a quartz glass tube W which has a circular pipe-like shape, and in which a spherical swollen portion $w_2$ is formed in a longitudinal middle area of a linear elongated portion $w_1$ is pinch-sealed in the vicinity of the spherical swollen portion $w_2$, and pinch seal portions 13 (a primary pinch seal portion 13A and a secondary pinch seal portion 13B) having a rectangular section shape are formed in both ends of an elliptic closed glass bulb (closed chamber portion) 12 that forms a discharge space, respectively. Tungsten electrode rods 60, 60 constituting discharge electrodes are opposingly placed in the closed glass bulb 12. The electrode rods 60, 60 are connected to molybdenum foils 7, 7 which are sealingly attached to the pinch seal portions 13 (13A, 13B), respectively. In the end portions of the pinch seal portions 13 (13A, 13B), molybdenum lead wires 8, 8 connected to the molybdenum foils 7, 7 are led out from circular pipe-like portions 14 which are non-pinch seal portions, respectively.

Figure 10:
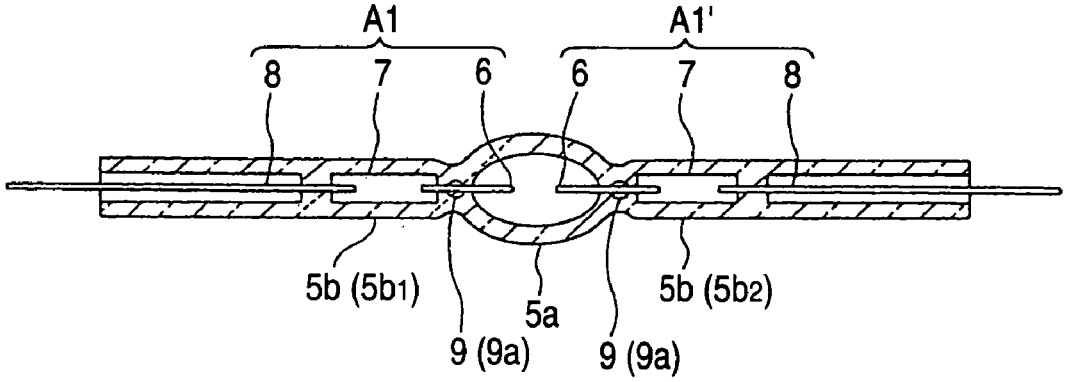
FIG. 10 is a longitudinal section view of a conventional arc tube.

The external structure of the arc tube 10 is superficially identical with the conventional arc tube 5 shown in FIG. 10. However, the arc tube is configured as a so-called mercury-free arc tube in which the closed glass bulb 12 is filled with a starting rare gas, a main luminescent metal halide, an auxiliary metal halide which is used in place of mercury, and the like (hereinafter, referred to as light emitting substances).

In order to provide compatibility with the quartz glass, minute projections and depressions are formed by strong electrolytic polishing on the outer peripheral face of each of the tungsten electrode rods 60. In a region of the glass layer of the pinch seal portion 13 which is in close contact with the electrode rod 60, a residual compression strain layer 16 which has a predetermined size, and which exhibits particularly high adhesiveness to the electrode rod 60 is formed by conducting pinch seal in a state where the glass tube is vacuumed.

As shown in FIGS. 2 and 3, the residual compression strain layer 16 extends along the electrode rod 60 to surround the electrode rod 60. The axial length $L_1$ of the layer is about 30% or longer of the axial length L of the region of the glass layer which is in close contact with only the electrode rod 60, and formed over an angular range $\theta_1$ of 180 degrees or more in the circumferential direction of the electrode rod 60.

Immediately after a pinch seal process, thermal stress is not generated in the interface between the glass layer 15 and the electrode rod 60. When the temperature is returned to the ordinary one, on the interface between the electrode rod (tungsten) 60 and the glass layer (quartz glass), thermal stress (tensile stress on the electrode rod, and compression stress on the glass layer) corresponding to the difference between the coefficients of linear expansion of the members ($45\times10^{-7}$ 1/° C., $5\times10^{-7}$ 1/° C.) acts, and a mode in which residual tensile strain is generated in the electrode rod 60, and residual compression strain is generated in the glass layers is established.

Moreover, the residual compression strain layer 16 in the glass layer is formed over a wide range, and the temperature of the arc tube 10 (the pinch seal portion 13) at light-on is not raised higher than that in a process of pinch-sealing the pinch seal portion 13. Therefore, thermal stress generated in the glass layer 15 of the pinch seal portion 13 by light-on acts so as to reduce compression strain which is residual in the glass layer 15 of the pinch seal portion 13, in both the axial and circumferential directions.

Namely, thermal stress (tensile thermal stress) in the direction of relaxing the residual compression strain acts on the glass layer 15 of the pinch seal portion at light-on. When the electrode rod 60 in the residual compression strain layer 16 extends by a small degree in the axial and circumferential directions, thermal stress concentrates on the residual compression strain layer 16, and repeatedly acts as a result of repetition of light-on operations, thereby causing a possibility that a vertical crack which may lead to leakage of the enclosed substances is generated in the glass layer 15. In the face of the glass layer 15 which is in close contact with the electrode rod 60, however, the residual compression strain layer 16 which exhibits particularly high adhesiveness to the electrode rod 60 is formed in the length $L_1$ (≧0.3 L) of about 30% or longer of the axial length L of the region of the glass layer 15 which is in close contact with only the electrode rod 60, and over the wide angular range $\theta_1$ (≧180 degrees) in the circumferential direction of the electrode rod 60. The compression strain layer (residual compression strain layer) 16 of the wide range relaxes (absorbs) efficiently thermal stress which is generated in the glass layer 15 in accordance with temperature rise.

In other words, thermal stress which is repeatedly generated is dispersed by the residual compression strain layer 16 existing over the wide range, and transmitted to the whole glass layer 15. Therefore, a vertical crack which may lead to leakage of the enclosed substances is not generated in the glass layer 15.

Furthermore, an interface crack 17 which surrounds the electrode rod 60, which arcuately (cylindrically) elongates, and which is observable with the naked eye is formed in the residual compression strain layer 16, so that thermal stress acting at light-on on the interface between the electrode rod 60 and the glass layer 15 is absorbed by relative sliding between the outer glass layer 15*a* and the inner glass layer 15*b* (the residual compression strain layer 16) along the interface crack 17.

At lighting-on, thermal stress is generated in the interface between the glass layer 15 and the electrode rod 60 in the pinch seal portion 13. As enlargedly shown in FIGS. 2 and 3, the glass layer 15*b* which is closely integrated with the electrode rod 60, and which is inside the interface crack 17 slides with respect to the glass layer 15*a* which is outside the interface crack 17, and the thermal stress acting on the interface between the glass layer 15 and the electrode rod 60 is absorbed by the interface crack 17. Therefore, there is no possibility that a vertical crack which may lead to leakage of the enclosed substances is generated in the glass layer 15.

In order that the residual compression strain layer 16 of the size of the axial length $L_1$≧0.3 L and $\theta_1$≧180 degrees is formed in the glass layer 15 of the pinch seal portion 13, desirably, a glass tube (a portion to be pinch-sealed) is pinch-sealed in a range from 2,000 to 2,300° C., preferably, from 2,100 to 2,200° C. in arc tube production steps which will be described later.

The electrode rods 60 which are opposed to each other in the closed chamber portion 12 are formed by a rod of a diameter of 0.3 to 0.35 mm which is thicker than the electrode 6 (diameter: 0.25 mm) used in the mercury arc tube disclosed in JP-A-2001-015067, and configured so that the tube power is maintained by compensating reduction of the tube voltage with increasing the tube current.

As the tungsten electrode rod 60, a thoriated tungsten electrode rod, a kalium-doped tungsten electrode rod, and a high-purity tungsten electrode rod are selectively used. The thoriated tungsten electrode rod is made of tungsten including 2 wt % of thoria ($ThO_2$), several dozen ppm of kalium (K), and 0.05 wt % or less of impurities. The kaliun-doped tungsten electrode rod is made of tungsten (tungsten with a purity of 99.95 wt % or more) including several dozen ppm of kalium (K). The high-purity tungsten (6N) electrode rod is made of tungsten with a purity of 99.9999 wt % or more.

A pincher for shaping the pinch seal portion 13 (the size of a section face of the pinch seal portion 13, and the like) is configured in the same manner as that in the case of a mercury arc tube. In the pinch seal portion 13, the amount of thermal contraction of the electrode rod 60 after pinch seal is large correspondingly with the thickness of the electrode rod 60, and also the residual compression strain layer (interface crack) formed around the electrode rod 60 is larger (the radii of the residual compression strain layer and the interface crack are larger) than that in a mercury arc tube. Consequently, the glass layer 15*a* outside the residual compression strain layer 16 (the interface crack 17) in the pinch seal portion 13 is correspondingly thinner than that in a mercury arc tube. When excessive thermal stress acts on the pinch seal portion 13, therefore, there is a possibility that a vertical crack is generated.

However, when the thoriated tungsten electrode rod, as the tungsten electrode rod 60, which was heat-treated at 1,600 to 2,200° C. in a vacuum atmosphere so that the size (radius) of the residual compression strain layer 16 (the interface crack 17) formed in pinch seal has a radius of 0.5 mm or less with respect to the pinch seal portion of a width of, for example, 2.2 mm, the glass layer 15*a* having a sufficient thickness (a thickness of 0.6 mm or larger) is formed outside the residual compression strain layer 16 (the interface crack 17) in the pinch seal portion 13 (having a width of 2.2 mm). Even when excessive thermal stress acts on the pinch seal portion 13, therefore, a vertical crack is not generated in the glass layer 15*a*. Specifically, the glass layer 15*a* having a thickness corresponding to strength which can sufficiently withstand excessive thermal stress acting on the pinch seal portion 13 is formed outside the residual compression strain layer 16 (the interface crack 17) in the pinch seal portion 13.

In addition, when the kalium-doped tungsten electrode rod or the high-purity tungsten electrode rod is used as the electrode rod instead of the thoriated tungsten electrode rod, by using the kalium-doped tungsten electrode rod heat-treated in a vacuum atmosphere at a temperature in a range from 1,400 to 2,000° C. or the high-purity (6N) tungsten electrode rod heat-treated in a vacuum atmosphere at a temperature in a range from 1,200 to 1,800° C., the glass layer 15*a* having a sufficient thickness (a thickness of 0.7 mm or larger) is formed outside the residual compression strain layer 16 (the interface crack 17) in the pinch seal portion 13 (having a width of 2.2 mm). Even when excessive thermal stress acts on the pinch seal portion 13, therefore, a vertical crack is not generated in the glass layer 15*a*.

By heat-treating the electrode rod (the thoriated tungsten electrode rod, the kalium-doped tungsten electrode rod, and high-purity tungsten electrode rod) in the vacuum atmosphere at the high temperature, not only water adsorbed to the surface of the electrode rod, and an oxide film, but also impurities (water and gases) in the electrode rod are removed away. Therefore, the amounts of impurities (water and gases) enclosed in the closed glass bulb 12 are very small, and characteristics such as the luminous flux and the luminous color in the arc tube are improved.

Hereinafter, the configuration of the surface structure of the electrode rod 60, the size of the residual compression strain layer 16 (the interface crack 17) in the pinch seal portion 13 and surrounding the electrode rod 60, and the like will be described in detail.

FIG. 4 shows the relationships between the vacuum heat treatment temperature of an electrode rod and the maximum length of crystal grains of the surface structure of the electrode rod. The thoriated tungsten electrode rods were vacuum heat-treated at 1,600° C., 2,000° C., 2,200° C., respectively, the kalium-doped tungsten electrode rods were vacuum heat-treated at 1,400° C., 1,600° C., 1,800° C., 2,000° C., respectively, and the high-purity tungsten electrode rod were vacuum heat-treated at 1,200° C., 1,400° C., 1,600° C., 2,000° C., respectively. The surface structures of the respective electrode rods were observed in an electron microscope at a magnification of 2,000 times. Crystal grains constituting the surface structures of the electrode rods were changed so as to exhibit a scale-like structure. In the thoriated tungsten electrode rod, when the vacuum heat treatment temperature was 1,600° C., the maximum length of crystal grains was 5 μm; when the vacuum heat treatment temperature was 2,000° C., the maximum length of crystal grains was 12 μm; and, when the vacuum heat treatment temperature was 2,200° C., the maximum length of crystal grains was 15 μm. In the kalium-doped tungsten electrode rod, when the vacuum heat treatment temperature was 1,400° C., the maximum length of crystal grains was 5 μm; when the vacuum heat treatment temperature was 1,600° C., the maximum length of crystal grains was 9 μm; when the vacuum heat treatment temperature was 1,800° C., the maximum length of crystal grains was 24 μm; and, when the vacuum heat treatment temperature was 2,000° C., the maximum length of crystal grains was 31 μm. In the high-purity tungsten electrode rod, when the vacuum heat treatment temperature was 1,200° C., the maximum length of crystal grains was 5 μm; when the vacuum heat treatment temperature was 1,400° C., the maximum length of crystal grains was 14 μm; when the vacuum heat treatment temperature was 1,600° C., the maximum length of crystal grains was 32 μm; and, when the vacuum heat treatment temperature was 2,000° C., the maximum length of crystal grains was 50 μm. In any cases for the three kinds of electrode rod each having different composition, it was ascertained that, as the vacuum heat treatment temperature is higher, scale-like crystal grains further grow (expand), and, as the vacuum heat treatment temperature is higher, the surface of an electrode is less roughened, and further flat.

FIGS. 7A, 7B and 7C show relationships between the thickness and vacuum heat treatment temperature of an electrode rod which was vacuum heat-treated, and the size of a residual compression strain layer (interface crack) formed in a pinch seal portion. In any cases for the three kinds of electrode rod each having different composition, it was ascertained that, as the vacuum heat treatment temperature is higher, the size (radius) of a residual compression strain layer (interface crack) formed in a pinch seal portion is smaller.

From these relationships, the thoriated tungsten electrode rod is vacuum heat-treated in the range from 1,600 to 2,200° C., and, in the surface structure of the thoriated tungsten electrode rod which was vacuum heat-treated at a low temperature (1,600° C.), the maximum length of crystal grains is short (the scale-like pattern is fine), and therefore the numbers of projections and depressions are large, and the mechanical bonding with respect to (the residual compression strain layer of) the glass layer is strong. Therefore, it is considered that the residual compression strain layer (interface crack) formed around the electrode rod of the pinch seal portion is large. By contrast, in the surface structure of an electrode rod which was vacuum heat-treated at a high temperature (2,200° C.), the maximum length of crystal grains is long (the scale-like pattern is rough), and therefore the numbers of projections and depressions are small, and the mechanical bonding with respect to (the residual compression strain layer of) the glass layer is weak. Therefore, it is considered that the residual compression strain layer (interface crack) formed around the electrode rod of the pinch seal portion is small.

Moreover, in the kalium-doped tungsten electrode rod vacuum heat-treated in the range from 1,400 to 2,000° C. and the high-purity tungsten electrode rod vacuum heat-treated in the range from 1,200 to 1,800° C., in the surface structure of the electrode rod which was vacuum heat-treated at a low temperature, the maximum length of crystal grains is short (the scale-like pattern is fine), and therefore the numbers of projections and depressions are large, and the mechanical bonding with respect to (the residual compression strain layer of) the glass layer is strong. Therefore, the residual compression strain layer (interface crack) formed around the electrode rod of the pinch seal portion is large. By contrast, in the surface structure of an electrode rod which was vacuum heat-treated at a high temperature, the maximum length of crystal grains is long (the scale-like pattern is rough), and therefore the numbers of projections and depressions are small, and the mechanical bonding with respect to (the residual compression strain layer of) the glass layer is weak. Therefore, the residual compression strain layer (interface crack) formed around the electrode rod of the pinch seal portion is small.

In addition, the kalium-doped tungsten electrode rod and the high-purity tungsten electrode rod are vacuum heat-treated as mentioned above, as shown in FIGS. 7B and 7C, it is ascertained that the size (radius) of a residual compression strain layer (interface crack) in the pinch seal portion (having a width of 2.2 mm) is reduced to 0.5 mm or less, and that the glass layer having a sufficient thickness (a thickness of 0.6 mm or larger) is formed outside the residual compression strain layer (interface crack) in the pinch seal portion (having a width of 2.2 mm).

Moreover, when the kalium-doped tungsten electrode rod vacuum heat-treated in the afore mentioned temperature range or the high-purity tungsten electrode rod vacuum heat-treated in the afore mentioned temperature range is used as the electrode rod, especially when the high-purity tungsten electrode rod vacuum heat-treated in the range from 1,200 to 1,800° C., it is ascertained that the size (radius) of a residual compression strain layer (interface crack) in the pinch seal portion (having a width of 2.2 mm) is further reduced, and that the glass layer having a more sufficient thickness is formed outside the residual compression strain layer (interface crack) in the pinch seal portion (having a width of 2.2 mm), compared with the case when the thoriated tungsten electrode rod vacuum heat-treated in the range from 1,600 to 2,200° C.

FIG. 5 shows relationships between the thickness of the thoriated electrode rod which was not vacuum heat-treated, and the size of a residual compression strain layer (interface crack), and the rate of the size of the residual compression strain layer (interface crack) with respect to ½ of the width of the pinch seal portion. As an electrode rod is thicker, the residual compression strain layer (interface crack) formed in the pinch seal portion is larger, and also the rate of the size with respect to ½ of the width of the pinch seal portion is larger. Namely, as an electrode rod is thicker, the thickness of the glass layer outside the residual compression strain layer (interface crack) is further gradually reduced.

FIG. 6 shows relationships between the size of a residual compression strain layer (interface crack) formed around the thoriated electrode rod which was not vacuum heat-treated, and the rate of generation of a vertical crack. When the size (radius) of a residual compression strain layer (interface crack) formed in a pinch seal portion is 0.5 mm or smaller, the rate of generation of a vertical crack in a pinch seal portion of a width of 2.2 mm is 0%, and, when the size (radius) of a residual compression strain layer (interface crack) exceeds 0.5 mm, the rate is rapidly increased. In order to prevent a vertical crack from being generated in a pinch seal portion (width: 2.2 mm), preferably, the size (radius) of a residual compression strain layer (interface crack) formed in the pinch seal portion is 0.5 mm or smaller, or namely the thickness of the glass layer outside the residual compression strain layer (interface crack) is 0.6 mm or more.

In order to set the size (radius) of a residual compression strain layer (interface crack) to be 0.5 mm or smaller, in the thoriated electrode rod having a thickness of 0.25 to 0.4 mm, it is preferable that the thoriated electrode rod is vacuum heat-treated at 1,600 to 2,200° C. in a vacuum atmosphere as shown in FIG. 7A.

In order to set the size (radius) of a residual compression strain layer (interface crack) to be 0.5 mm or smaller, in the kalium-doped tungsten electrode rod or the high-purity tungsten electrode rod having a thickness of 0.25 to 0.4 mm, there is no need of the vacuum heat-treating, as shown in FIGS. 7B and 7C. However, in order to remove not only water adsorbed to the surface of the electrode rod, and an oxide film, but also impurities (water and gases) in the electrode rod, so as to improve characteristics such as the luminous flux and the luminous color, it is preferable that the kalium-doped tungsten electrode rod is vacuum heat-treated in the range from 1,400 to 2,000° C., or the high-purity tungsten electrode rod is vacuum heat-treaded in the range from 1,200 to 1,800° C.

In the embodiment, the electrode rods 60 which are opposingly disposed in the closed glass bulb 12 are configured by the thoriated tungsten electrode rods which were heat-treated at 1,600 to 2,200° C. in a vacuum atmosphere, the kalium-doped tungsten electrode rods which were heat-treated at 1,400 to 2,000° C. in a vacuum atmosphere or the high-purity tungsten electrode rods which were heat-treated at 1,200 to 1,800° C. in a vacuum atmosphere, and which have a thickness of 0.30 to 0.35 mm, and, around the electrode rod 60 in the pinch seal portion (width: 2.2 mm) 13, the residual compression strain layer 16 (the interface crack 17) having a radius of 0.5 mm or less (about ¼ or less of the width 2.2 mm of the pinch seal portion) is formed. The glass layer 15*a* having a thickness of 0.6 mm or more (about ¼ or more of the width of the pinch seal portion) is formed around the residual compression strain layer 16 (the interface crack 17). When thermal stress at a temperature which is lower than that in pinch-sealing the pinch seal portion 13 acts, therefore, it is a matter of course that thermal stress is efficiently relaxed (absorbed) by the residual compression strain layer 16 and the interface crack 17 as described above. The glass layer 15*a* having a thickness of 0.6 mm or more (about ¼ or more of the width of the pinch seal portion) and around the residual compression strain layer 16 (the interface crack 17) is burdened with thermal stress which has not been relaxed (absorbed) by the residual compression strain layer 16 and the interface crack 17. Therefore, a vertical crack is not generated in the pinch seal portion 13.

Next, steps of producing the mercury-free arc tube 10 shown in FIG. 1 will be described with reference to FIGS. 8A to 8E.

First, the glass tube W in which the spherical swollen portion $w_2$ is formed in a middle area of the linear elongated portion $w_1$ is previously produced. The electrode rod 60 of an electrode assembly A is previously configured by a tungsten electrode rod which has a thickness of 0.3 to 0.35 mm, and which was vacuum heat-treated at a temperature of 1,600° C. or higher so that the maximum length of crystal grains of the surface structure of the electrode rod is 5 μm or longer. As shown in FIG. 8A, the glass tube W is perpendicularly held, the electrode assembly A is inserted from a lower open end of the glass tube W to be held at a predetermined position, and a nozzle 40 for supplying an inert gas (argon gas or nitrogen gas) is inserted from an upper open end of the glass tube W. A lower end portion of the glass tube W is inserted into a pipe 50 for supplying an inert gas (argon gas or nitrogen gas).

An inert gas which is supplied from the nozzle 40 is used for preventing the electrode assembly A in pinch seal from being oxidized. An inert gas which is supplied from the gas supply pipe 50 is used for holding the lead wire 8 in a high-temperature state during and after pinch seal, to an inert-gas atmosphere, thereby preventing the lead wire 8 from being oxidized. The reference numerals 42 and 52 in FIG. 8A denote gas cylinders which are filled with the respective inert gases, 44 and 54 denote gas-pressure regulators, and 22 denotes a glass tube grasping member.

As shown in FIG. 8A, while supplying the inert gas from the nozzle 40 into the glass tube W and further supplying the inert gas from the pipe 50 to the lower end portion of the glass tube W, a position (including the molybdenum foil) of the linear elongated portion $w_1$ in the vicinity of the spherical swollen portion $w_2$ is heated to 2,100° C. by burners 24*a*, and the side of the molybdenum foil 7 to which the lead wire 8 is connected is provisionally pinch-sealed by a pincher 26*a*.

After the provisional pinch seal, as shown in FIG. 8B, the interior of the glass tube W is held to a vacuum state (the pressure of 400 Torr or lower) by a vacuum pump (not shown), the glass tube is heated to 2,100° C. by burners 24*b*, and a non-pinch seal portion including the molybdenum foil 7 is regularly pinch-sealed by a pincher 26*b*. Preferably, the degree of vacuum applied to the interior of the glass tube W is 400 to $4\times10^{-3}$ Torr.

As a result, the primary pinch seal portion 13A is in the state where the glass layer 15 is in close contact with the electrode rod 60, the molybdenum foil 7, and the lead wire 8 which constitute the electrode assembly A. In the portion where the regular pinch seal has been conducted, the glass layer 15 is in close contact with the electrode rod 60 and the molybdenum foil 7 without forming a gap to provide sufficient compatibility, and hence a mode in which the glass layer 15 and the molybdenum foil 7 (the electrode rod 60) are firmly bonded together is established. When the primary pinch seal portion is cooled, the residual compression strain layer 16 of a predetermined size is formed, and the interface crack 17 is formed on the outer periphery of the residual compression strain layer 16. The size of the residual compression strain layer 16 (the interface crack 17) is formed to have a radius of 0.5 mm or less with respect to the pinch seal portion 13 of the width of 2.2 mm, and the glass layer having a thickness of 0.6 mm or more is formed outside the residual compression strain layer 16 (the interface crack 17).

Also in the regular pinch sealing step, the lead wire 8 can be prevented from being oxidized, by holding the lower opening of the glass tube W to an inert-gas (argon gas or nitrogen gas) atmosphere.

Next, as shown in FIG. 8C, from the upper open end of the glass tube W, the light emitting substances P are charged into the spherical swollen portion $w_2$, and the other electrode assembly A' in which the electrode rod 60, the molybdenum foil 7, and the lead wire 8 are connected and integrated together is inserted and held at a predetermined position, In the same manner as the electrode rod 60 of the electrode assembly A, the electrode rod 60 of the electrode assembly A' is configured by a tungsten electrode rod which has a thickness of 0.3 to 0.35 mm, and which was vacuum heat-treated at a temperature of 1,600° C. or higher so that the maximum length of crystal grains of the surface structure of the electrode rod is 5 μm or longer. In the lead wire 8, a W-shaped bent portion 8*b* having a width which is larger than the inner diameter of the glass tube W is formed in a longitudinal middle area. The bent portion 8*b* has a form in which it is pressingly contacted with the inner peripheral face of the glass tube W, so that the electrode assembly A' can be positioned and held at a predetermined longitudinal position of the linear elongated portion $w_1$.

After the glass tube W is evacuated, as shown in FIG. 8D, a predetermined upper position of the glass tube W is chipped off while xenon gas is supplied into the glass tube W, whereby the electrode assembly A' with the lead wire is provisionally fixed into the glass tube W, and the light emitting substances are enclosed. The reference numeral $w_3$ denotes a chip off portion.

Thereafter, as shown in FIG. 8E, a position (including the molybdenum foil) of the linear elongated portion $w_1$ in the vicinity of the spherical swollen portion $w_2$ is heated to 2,100° C. by the burners 24 while the spherical swollen portion $w_2$ is cooled by liquid nitrogen so that the light emitting substances P do not vaporize, whereby a secondary pinch seal process is conducted by a pincher 26*c* to hermetically seal the spherical swollen portion $w_2$. As a result, a mercury-free arc tube having the closed glass bulb 12 in which the electrodes 6, 6 are opposingly disposed, and which is filled with the light emitting substances P is completed.

In the secondary pinch sealing step, while the interior of the glass tube W is not necessary to be negatively pressurized by the vacuum pump unlike the regular pinch seal of the primary pinch sealing step, the interior of the glass tube W is maintained to a negative pressure by liquefying the xenon gas enclosed in the glass tube W. Therefore, the glass layer in the secondary pinch seal portion 13B exhibits excellent adhesiveness to the electrode assembly A' (the electrode rod 60, the molybdenum foil 7, and the lead wire 8).

In the same manner as the regular pinch seal of the primary pinch sealing step, the glass layer which is heated to be softened is subjected to the negative pressure in addition to the pressing force of the pincher 26*c*, and hence the glass layer is in close contact with the electrode rod 60, the molybdenum foil 7, and the lead wire 8 without forming a gap to provide sufficient compatibility, thereby producing a mode where the glass layer is firmly bonded to the electrode rod 60, the molybdenum foil 7, and the lead wire 8. When the secondary pinch seal portion 13B is cooled, therefore, the residual compression strain layer 16 and the interface crack 17 which are similar to those formed in the primary pinch seal portion 13A are formed. The size of the residual compression strain layer 16 (the interface crack 17) is formed to have a radius of 0.5 mm or less with respect to the pinch seal portion 13 of the width of 2.2 mm, and the glass layer having a thickness of 0.6 mm or more is formed outside the residual compression strain layer 16 (the interface crack 17).

Finally, end portions of the arc tube are cut off by a predetermined length to obtain the arc tube 10 shown in FIG. 1. The size of the residual compression strain layer 16 disposed in each of the pinch seal portions of the produced arc tube is measured by a strain gauge (not shown). When the size of the residual compression strain layer 16 (the interface crack 17) is not larger than a predetermined value (for example, 0.5 mm) (the thickness of the glass layer outside the residual compression strain layer 16 is not smaller than a predetermined value (for example, 0.6 mm)), the arc tube is judged acceptable, and, when the size of the residual compression strain layer 16 (the interface crack 17) is not smaller than a predetermined value (for example, 0.5 mm) (the thickness of the glass layer outside the residual compression strain layer 16 is not larger than a predetermined value (for example, 0.6 mm)), the arc tube is judged unacceptable.

The embodiment has the structure in which the residual compression strain layer 16 of a predetermined size is formed on the side that is closely contacted with the electrode rod 60 of the glass layer 15 in each of the pinch seal portions 13 (13A, 13B) of the front and rear end sides, and the interface crack 17 is formed on the outer periphery of the residual compression strain layer 16. Alternatively, the interface crack 17 may not be formed on the outer periphery of the residual compression strain layer 16.

It has been described that, in the embodiment, the residual compression strain layer 16 formed on the side that is closely contacted with the electrode rod 60 of the glass layer 15 in the pinch seal portion 13 has the predetermined axial length $L_1$ and the predetermined circumferential angle $\theta_1$. Alternatively, the layer may have only the predetermined axial length $L_1$, or only the predetermined circumferential angle $\theta_1$.

Moreover, in the embodiment, as the electrode rod 60 opposingly disposed in the closed glass bulb 12, one of thoriated tungsten electrode rod vacuum heat-treated in the range from 1,600 to 2,200° C., the kalium-doped tungsten electrode rod heat-treated in the range from 1,400 to 2,000° C. and high-purity tungsten electrode rod heat-treated in the range from 1,200 to 1,800° C. is used. Alternatively, as the electrode rod 60, the kalium-doped tungsten electrode rod without the vacuum heat-treatment or the high-purity tungsten electrode rod without the vacuum heat-treatment may be used, when the glass layer having a sufficient thickness formed outside the residual compression strain layer (interface crack) in the pinch seal portion is only required.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A mercury-free arc tube for a discharge lamp device, comprising:

a closed glass bulb disposed in a middle of a glass tube, wherein a starting rare gas and a light emitting substance are enclosed in the closed glass bulb;

a tungsten electrode rod sealingly attached to a pinch seal portion disposed in an end of the glass tube, wherein a tip end portion of the electrode rod projects in the closed glass bulb; and a residual compression strain layer formed in a contact face between a glass layer in the pinch seal portion and the electrode rod, wherein the residual compression strain layer surrounds the electrode rod, wherein the electrode rod has a diameter of 0.3 mm or more, and the residual compression strain layer has a radius $R \leqq D/4$ about the electrode rod with respect to a width D of the pinch seal portion, the width D of the pinch seal portion is in a direction that is perpendicular to a longitudinal direction of the arc tube.

2. The mercury-free arc tube according to claim 1, wherein the electrode rod is heat-treated in a vacuum atmosphere and at a predetermined temperature proportional to the diameter of the electrode rod in a range from 1,200 to 2,200° C.

3. The mercury-free arc tube according to claim 2, wherein the electrode rod comprises a thoriated tungsten electrode rod, and the predetermined temperature is in a range from 1,600 to 2,200° C.

4. The mercury-free arc tube according to claim 1, wherein the electrode rod comprises a kalium-doped tungsten electrode rod.

5. The mercury-free arc tube according to claim 4, wherein the electrode rod is heat-treated in a vacuum atmosphere and at a predetermined temperature proportional to the diameter of the electrode rod in a range from 1,400 to 2,000° C.

6. The mercury-free arc tube according to claim 1, wherein the electrode rod comprises a high-purity tungsten electrode rod.

7. The mercury-free arc tube according to claim 6, wherein the electrode rod is heat-treated in a vacuum atmosphere and at a predetermined temperature proportional to the diameter of the electrode rod in a range from 1,200 to 1,800° C.

8. The mercury-free arc tube according to claim 1, wherein tungsten crystal grains constituting a surface structure of each of said electrode rods have a maximum length of 5 μm or longer.

* * * * *